United States Patent [19]

Ordines

[11] 4,216,755

[45] Aug. 12, 1980

[54] HIGH TENSION DISTRIBUTING DEVICE

[75] Inventor: Jean-Pierre Ordines, Clamart, France

[73] Assignee: Societe pour l'Equipement de Vehicules, Issy-les-Moulineaux, France

[21] Appl. No.: 912,713

[22] Filed: Jun. 5, 1978

[30] Foreign Application Priority Data

Jun. 10, 1977 [FR] France ..... 77 17876

[51] Int. Cl.[2] ..... F02P 7/00

[52] U.S. Cl. ..... 123/643; 123/650

[58] Field of Search ..... 123/148 E, 148 DS, 148 ND

[56] References Cited

U.S. PATENT DOCUMENTS

| | | | |
|---|---|---|---|
| 1,351,396 | 8/1920 | Midgley | 123/148 DS |
| 2,322,584 | 6/1943 | Nardone | 123/148 DS |
| 3,242,916 | 3/1966 | Coufal | 123/148 E |
| 3,759,237 | 9/1973 | Shino et al. | 123/148 DS |
| 3,828,752 | 8/1974 | Hioki et al. | 123/148 E |
| 3,900,015 | 8/1975 | Mainprize | 123/148 E |
| 4,007,724 | 2/1977 | Mura | 123/148 E |
| 4,008,698 | 2/1977 | Gartner | 123/148 E |
| 4,104,997 | 8/1978 | Padgitt | 123/148 E |

*Primary Examiner*—Charles J. Myhre
*Assistant Examiner*—Andrew M. Dolinar
*Attorney, Agent, or Firm*—Brisebois & Kruger

[57] ABSTRACT

The invention provides a distributor device for H.T. supply to an internal combustion engine, and comprising several ignition coils and a single contact breaker to interrupt supply to one or more of those coils at any instant, each of the coils having its primary winding shunted by a thyristor which can be controlled to select whether the primary winding of that particular coil is to be energized, or not, as the case may be.

In one embodiment, the thyristors are polarized so as to conduct in a direction allowing "idling" circulation of current through the closed circuit comprising the shunting thyristor and its associated primary winding; in another embodiment the thyristors are polarized in the reverse direction and a diode is connected between the gate and the cathode of each thyristor to protect the cathode from gate voltage and another diode is connected to protect the gating circuit of that particular thyristor. The coils may be connected all in series, or all in parallel, or in parallel-connected sub-assemblies which are then strung in series.

18 Claims, 7 Drawing Figures

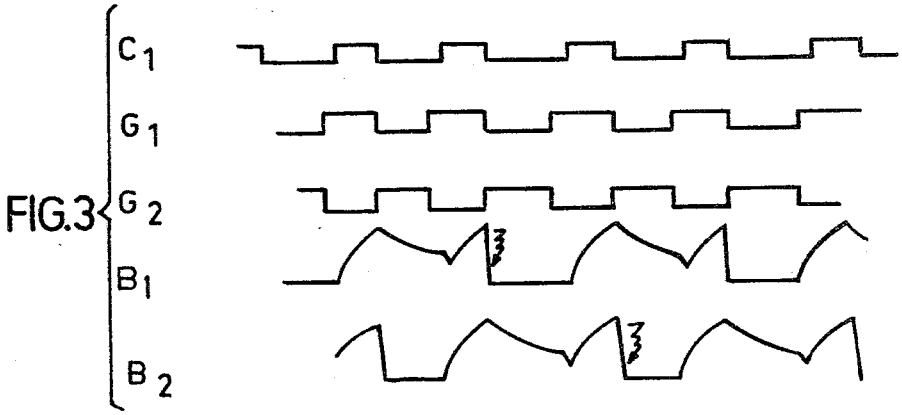
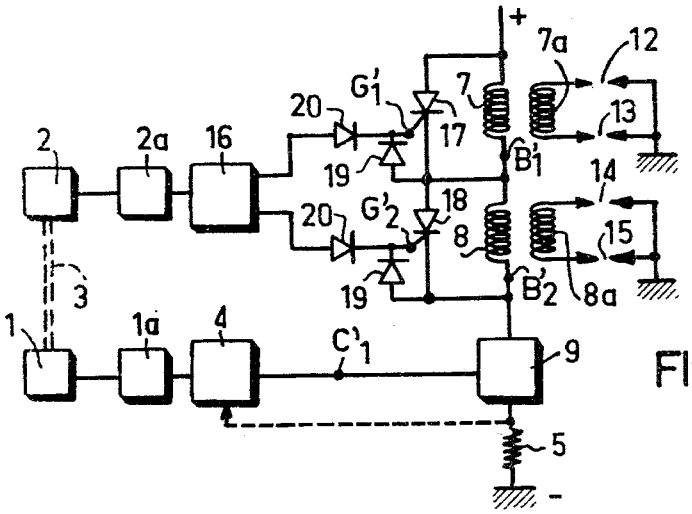
FIG.4
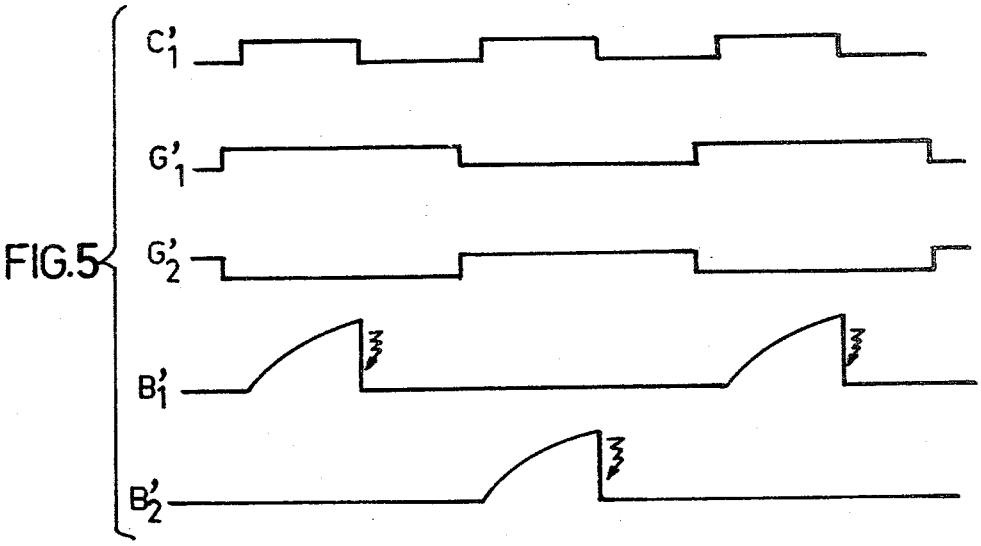

HIGH TENSION DISTRIBUTING DEVICE

It is known that internal combustion engines such as those used for the propulsion of motor vehicles generally comprise for each cylinder at least one sparking plug, which is energised at every power stroke by a high tension produced by the secondary winding of an ignition coil. Since, in the devices known at present, a single ignition coil is provided for energising all the sparking plugs of the combustion engine, it is necessary to use a distributor which receives the high tension output from the secondary winding of the coil and which distributes the said high voltage successively to each sparking plug. This function is, in the conventional way, effected by a rotor arm which is caused to rotate by the distributor shaft connected to the engine and has an end displaced past as many fixed contact points as there are sparking plugs to be energised, all these contact points being mounted on a cap made of insulating material covering the top part of the distributor connected to the engine. When the motor arm arrives opposite a point connected to a sparking plug, the said arm receives a high voltage current from the secondary winding of the coil; the current passes from the prior arm to the nearby contact point, but in the gap therebetween losses will occur which diminish the energy available for the spark.

Moreover, if the ignition efficiency is to be improved, the voltage supplied to the sparking plug is usually increased. However, if this voltage is increased, unless the precaution is taken of interspacing the contact points adequately from each other, there is the risk of creating stray connections within the cap between the rotor arm and the other contact points which are not opposite it but are relatively near. This has the result that when the value of the ignition voltage is increased, a distributor cap having large dimensions must be provided if undesirable stray ignitions are to be avoided. This essential requirement is a considerable disadvantage, taking into consideration the fact that the distributor cap then becomes very bulky and difficult to position in the engine compartment of the motor vehicle.

The purpose of the present invention is to propose a device for the distribution of high voltage current intended for the ignition of sparking plugs of an internal combustion engine, this device permitting the ignition voltage distributed to be increased without the disadvantage of bulky size. To do this, one could envisage associating with each sparking plug, the secondary winding of a respective H.T. coil whose primary winding would be in series with a power transistor fulfilling the function of a contact breaker. It will be found that in this case, it would be necessary to use as many power transistors as there are sparking plugs. However, power transistors are expensive components and the construction of such a device is not considered practicable. To diminish the number of power transistors, one can connect two of the sparking plugs to one H.T. coil secondary winding to that sparks will be produced simultaneously in these two plugs; this is acceptable provided these two sparking plugs correspond to a pair of cylinders of which one is on the combustion stroke stage and the other on the exhaust stroke. In this case, it is nevertheless, necessary to use p/2 power transistors for the ignition of p sparking plugs and consequently, this technique is considered uneconomic. The purpose of the present invention is to propose a device allowing the use of a single power transistor or an equivalent single transistorised interruptor device irrespective of the number of sparking plugs to be energised.

According to the present invention there is provided a device for the distribution of high tension for the ignition of the sparking plugs of an internal combustion engine, this device comprising: n ignition coils each comprising a primary induction winding and a secondary induced winding; p sparking plugs associated with the n ignition coils, p and n being integers and p being greater than or equal to n, at least one ignition coil secondary winding being connected to each plug of the device; n switches operated successively in the course of time and on a periodic basis for a constant speed of rotation of the engine, each switch being connected to shunt a respective one of said ignition coils; and a single contact breaker connected is series with the primary windings of all the ignition coils.

In a preferred embodiment of the device according to the invention, when the contact breaker is open at least one of said switches is open. Conveniently, when the contact breaker is open a single said switch is open, all the others being closed.

In a first alternative embodiment, the primary windings of n ignition coils are arranged in series. In a second alternative embodiment, the primary windings of n ignition coils are arranged in parallel. In a third alternative embodiment, certain ignition coil primary windings constitute at least one parallel-connected group and other primary windings are arranged in a parallel-connected group in series with the said at least one parallel-connected group.

Said switches may advantageously be thyristors. The power breaker may be either a power transistor or by the combination of two transistors in a "Darlington pair" arrangement.

In the above mentioned first alternative embodiment, the thyristor connected to each ignition coil primary winding is capable, when the power breaker is open and the thyristor is triggered, of letting current pass in the direction corresponding to current circulation in a closed circuit comprising the thyristor and the associated primary winding. According to a second possibility, for the same variant, the thyristor associated with each primary coil winding is capable of letting the current pass only in the reverse direction to that previously defined. In the preferred form of this embodiment the cathode of each transistor is connected to its gate by a diode polarised to pass in the direction from cathode to gate, and another diode is provided, polarised to oppose the communication voltage from the thyristor gate to the control circuit of the said gate.

In the case of the above mentioned second embodiment of the invention, a diode is interposed between on the one hand each sub-assembly constituted by a primary winding and its shunt thyristor, and on the other hand the contact breaker, the said diode being polarised to pass from the primary winding towards the contact breaker transistor.

It is clear that several sparking plugs may be associated with each ignition coil secondary winding of the device. Preference is given to associating with each secondary winding, two sparking plugs corresponding to the two cylinders of a pair, of which one cylinder is on the exhaust stroke when the other is on the power stroke.

According to the invention, provision may advantageously be made for the base of the or a power transistor of the contact breaker to be controlled by a proximity sensor driven by the distributor shaft which is connected to the engine, possibly with the interposition of an electronic "control circuit" allowing the instant of closing of the power breaker constituted by the power transistor to be determined so as to obtain an ignition with constant energy irrespective of the engine speed of rotation. In this case, a resistor is interposed between the power supply and that terminal of the power transistor which is not connected to the ignition coil primary windings, a resistor from a control voltage being taken from the terminals of this resistor to determine the instant of opening or closing of the power transistor. Such systems intended to obtain ignition with constant energy have already been described, for instance in French Patent Application No. 76-19733 assigned to the assignees of the present invention. When no such controlling system is used, a resistor is nevertheless arranged in series with the power transistor in order to limit the current passing into the ignition coil primary windings.

The gates of the thyristors used as coil shunt switches may conveniently be controlled by means of a sensor different from that which controls the opening of the contact breaker. This sensor may be mounted on the same shaft as the first sensor. The signal emitted by this second sensor may conveniently be shaped in an appropriate circuit and then be amplified. In the case where a device is used comprising two primary windings, the two gates of the two associated thyristors may conveniently be controlled by signals emitted by the amplifier which complement each other. The signals applied to the two gates and to the power transistor are square wave signals and the change in the level of the signals received by the gates of the two thyristors is effected just before one of the changes in the level of the control signal applied to the contact breaker, for instance, the change in level corresponding to the rising front of the contact breaker control signal.

In the above-mentioned first embodiment of the invention, the energisation current of the primary windings is the same as the current passing through the power transistor; in the above-mentioned second embodiment the current passing through the power transistor is, on the contrary, equal to n times the charging current which traverses each one of the ignition coil primary windings. It is therefore clear in this connection, that for purely economic reasons, the first embodiment is more advantageous because a transistor supporting, at a given voltage, a current i is less expensive than a transistor which at the same voltage supports a current which is an integral multiple of i.

Nevertheless, in the first embodiment of the invention, the coil inductive impedance to the passage of the energisation current is due to the inductance of n coils arranged in series whereas in the second invention, this inductance in each branch of the parallel circuit is only due to the action of a single coil. This has the result that in the case of the second embodiment of the invention, the energisation time of the primary windings as a whole is smaller than in the case of the first embodiment which constitutes an advantage if it is required to energise the primary windings to an adequate level when the engine is turning at great speed.

Nevertheless in the device according to the first embodiment of the invention where the shunt thyristors oppose idling current circulation in the shunted coil when the contact breaker opens to discharge the non-shunted coil, a voilent discharge is produced in one of the primary windings and a relatively slow discharge in the other primary winding. If the engine speed of rotation is relatively low, the slow discharge leads to a complete discharge of the primary winding in question. On the other hand, if the engine speed of rotation is high, the time of the inception of energisation occurs before the end of the discharge time of that primary winding; the fact that a complete discharge of the primary winding is avoided thus makes it possible to offset the aforementioned slow rate of reacharging of the primary winding due to the arrangement of the primary winding adopted in this first embodiment.

In order that the present invention may more readily be understood, three alternative embodiments of a sparking power distribution device in accordance with the invention will now be described, by way of purely illustrative and nonrestrictive examples, with reference to the accompanying drawings, in which:

FIG. 3 shows the signals at various points of the circuit of FIG. 1 for high engine rotation speeds;

FIG. 4 shows the circuit of a second embodiment of the invention;

FIG. 5 represents the signals at various points of the circuit of FIG. 4;

Figure 1:
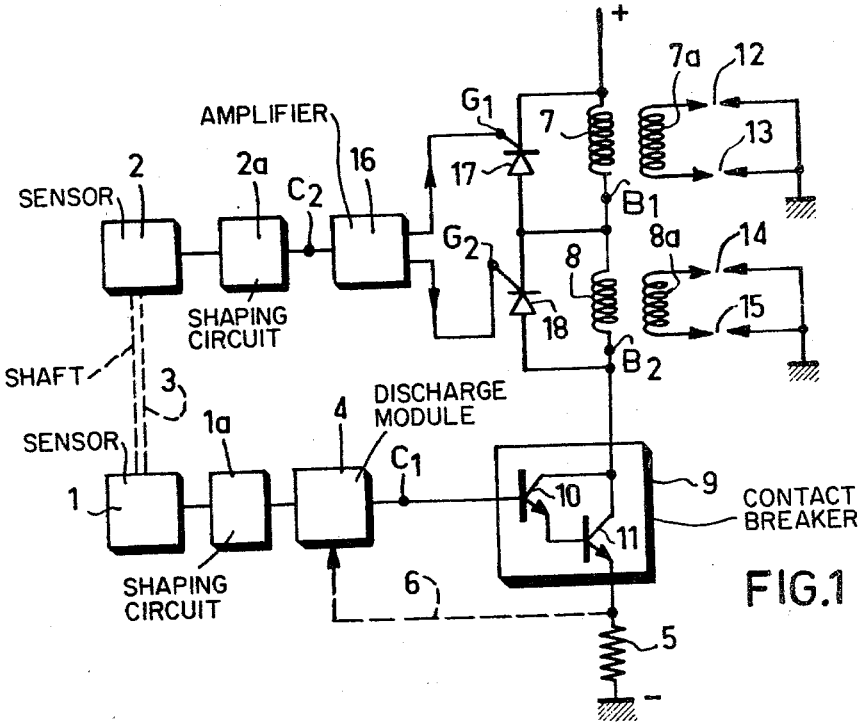
FIG. 1 shows the circuit of a first embodiment of the device according to the invention.
Figure 2:
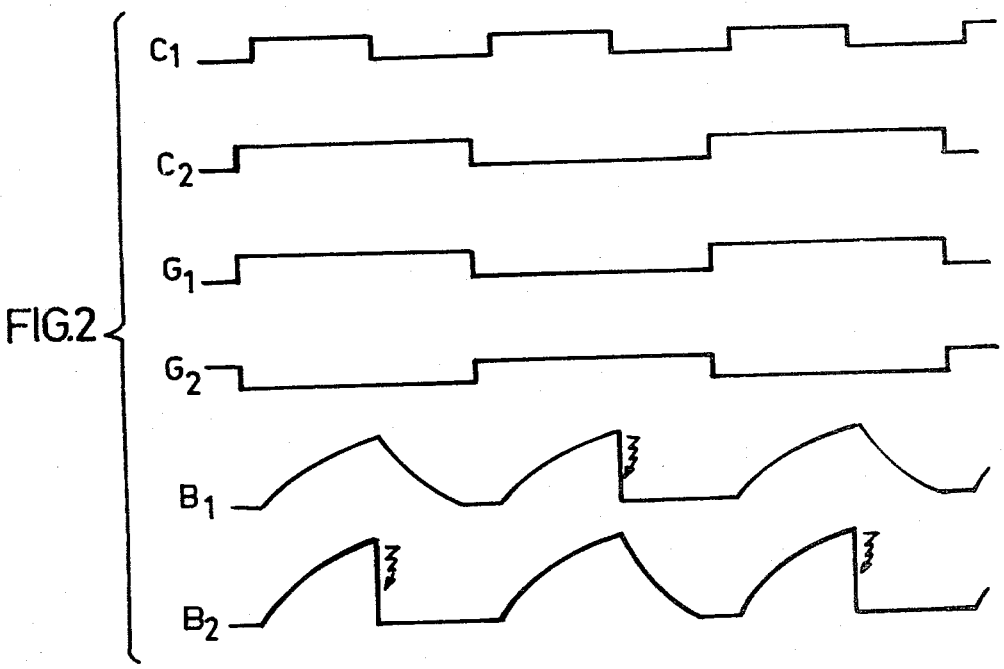
FIG. 2 shows the signals at various points of the circuit of FIG. 1 at low engine rotation speeds.

Referring to FIGS. 1 to 3, there will be seen the two rotation sensors 1 and 2 used for the control of the ignition current distribution device according to the invention. The two rotation sensors 1 and 2 are proximity sensors of the conventional type arranged on the distributor shaft connected to the internal combustion engine to the various sparking plugs of which the device according to the present invention is intended to supply the high voltage current. The common shaft of the two rotating discs associated with the two rotation sensors 1 and 2 has been designated as 3 in the drawing. The two sensors 1 and 2 have their output signals applied to the shaping circuits 1*a*, 2*a*, respectively, in order to produce square wave signals. In the embodiment shown, sensor 1 supplies an electronic module 4 allowing the instant of the start of charging of an ignition coil to be determined so as to obtain a constant discharge of energy irrespective of the engine rotation speed; such a device has been described in our said French Patent Application 76-19733. Module 4 is controlled by a voltage taken from the terminals of a resistor 5 and the control has been represented schematically by the dashed line 6.

In this embodiment of the device according to the invention there are two ignition coils whose primary windings 7 and 8 are arranged in series, one of the ends of the series connection being connected to the positive L.T. lead, while the other end is connected to a power contact breaker 9 constituted by the association of two transistors 10 and 11 forming a Darlington pair. Associated with the primary windings 7 and 8, are the induced secondary windings 7*a* and 8*a*, respectively, to the terminals of which are connected sparking plugs 12 and 13 for winding 7*a*, and 14 and 15 for winding 8*a*. Across the terminals of the primary windings 7 and 8 are two thyristors 17 and 18 whose gates $G_1$ and $G_2$ are connected respectively to the output of amplifier 16 which is supplied by the signal from the shaping circuit 2a. The output signals from circuits 4 and 2a are represented on the first and second lines of FIG. 2 respectively. The output signals from amplifier 16 have been represented on the third and fourth lines of FIG. 2 and are complementary to each other. When the signal to one thyristor gate is at the high level, the thyristor is conducting; when the signal at the base of transistor 10 (i.e. the output from module 4) is at a high level, the contact breaker circuit 9 is closed, i.e., conductive.

The functioning of the circuit described above will be readily understood from the following.

When the contact breaker 9 is closed, the primary winding 7 and 8 will become energised. At the instant when the signal applied to the base of transistor 10 passes to the low level, the thyristor 17 is still passing (to bypass primary winding 7) and thyristor 18 is extinguished. Since the contact breaker 9 then becomes open, i.e. non-conductive, there will be a sudden interruption of current in primary winding 8 which, by induction in the secondary, entails production of a spark at both of the plugs 14 and 15. Meanwhile, at winding 7, the current continues to flow by way of thyristor 17, so that the current in the primary winding 7 decays, but only slowly, which does not produce an spark on plugs 12 and 13.

When the signals at gates $G_1$ and $G_2$ change their level, the switches constituted by thyristors 17 and 18 change their state ready for the next interruption. After a short while the next rising front appears in the signal applied to the base of transistor 10, causing the contact breaker 9 to close and resulting in simultaneous energising of primary winding 7 and, to a certain extent also the primary winding 8. At the end when the contact breaker 9 is again opened, by the descending front of the signal applied to the base of transistor 10, discharge is produced on plugs 12 and 13 and not on plugs 14 and 15.

Of course, sparking plugs 12 and 13 on the one hand, and 14 and 15 on the other hand, are connected to respective pairs of cylinders such that one cylinder of each pair is on the exhaust stroke while the other is on the power stroke. Thus, without a distributor of the conventional type, the high tension supply to the four sparking plugs of a four stroke four cylinder engine can be correctly timed and sequenced.

It will thus be seen that with two successive cycles of the signals supplied by sensor 2, there will be firstly ignition on plugs 12 and 13, and then ignition on plugs 14 and 15. On the fifth and sixth lines of FIG. 2, the current values at points $B_1$ and $B_2$ of primary windings 7 and 8 have been represented for a low engine rotation speed. Discharge is always completed before the next energisation.

On the other hand, when the engine rotation speed is high, as shown in FIG. 3, the discharge of that of the primary windings which is being discharged via its shunt thyristor is effected slowly, so that that discharge is not complete when the beginning of a new charging period intervenes. There will then be a readjustment in the balance between the two primary windings 7 and 8, one of which is completely discharged and the other of which is still slightly energised when the next energisation phase occurs. It will thus be understood that this use of the residual energy at high speeds allows the ignition to be improved, since one of the essential difficulties in obtaining good ignition at high speeds derives from the fact that the charging time of the primary winding is frequently insufficient to obtain an adequate energy level before "contact break".

FIG. 4 shows a second embodiment of the present invention. In this embodiment, all the elements appearing in the circuit of FIG. 1 are found again. Therefore, the corresponding elements which recur in the two embodiments have been designated by the same reference numbers. The only difference between the two circuits concerns the arrangement of thyristors 17 and 18.

In the circuit of FIG. 1, the thyristors 17 and 18 are arranged so that when the contact breaker 9 has opened current may still circulate in a closed circuit comprising one of the primary windings 7 and 8 and its conductive shunt thyristor 17 or 18, respectively. On the other hand, in the circuit shown in FIG. 4, the thyristors are orientated in the reverse direction to that adopted for FIG. 1 to resist this "residual current" effect. The control signal applied to contact breaker circuit 9 is represented on the first line of FIG. 5; the control signals applied to the gates $G'_1$ and $G'_2$ of thyristors 17 and 18 have been represented on the second and third lines respectively, of FIG. 5. Thus the three signals represented on the first three lines of FIG. 4 are exactly the same as those represented on the first line, the third line, and the fourth line of FIG. 1.

When contact breaker 9 is closed, that is to say when the signal at $C'_1$ is at its high level, the primary windings 7 and 8 are energised. If the gate of thyristor 17 receives a signal at its high level, thyristor 17 is conductive, whereas thyristor 18 is extinguished and therefore only primary winding 8 is being energised. When the signal at $C'_1$ passes to its low level, this produces interruption of current in primary winding 8 and therefore, the high voltage discharge on plugs 14 and 15.

There will then be an inversion in the signals on the gates of thyristors 17 and 18 so that in the following cycle of the signal applied at $C'_1$ it is only the primary winding 7 which is being charged, while primary winding 8 is charged no longer. Thus one alternately obtains the charging of one of the primary windings followed by the discharge of that winding.

When the current is interrupted in primary winding 7, the voltage rises sharply and the cathode of thyristor 17 passes to a voltage which is much higher than that obtaining at the gate of no precaution were to be taken. To prevent this unwelcome difference in voltage between the cathode and the gate of thyristor 17 and of thyristor 18, a diode 19 is arranged between the cathode and the gate which makes it possible to bring the gate to a voltage very close to that of the cathode; but in this case, to prevent the voltage peak obtaining at the moment of discharge from disturbing the upstream elements 2a, 16, another diode 20 is arranged ahead of the gates as a protection device. The representation of the currents at points $B'_2$ and $B'_1$ of the primary windings 8 and 7 is on the fourth and fifth line of FIG. 5.

It will be seen that this device allows substantially the same results as that of FIG. 1, save for the difference that only one primary winding is being charged at a time which limits the current consumption by the Joule effect in the windings.

Figure 6:
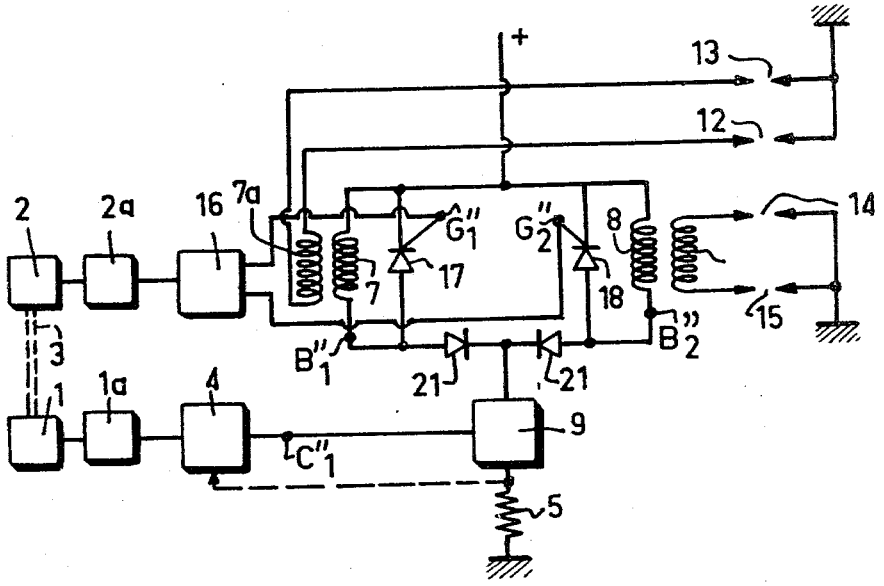
FIG. 6 illustrates a further embodiment of the device according to the invention.
Figure 7:
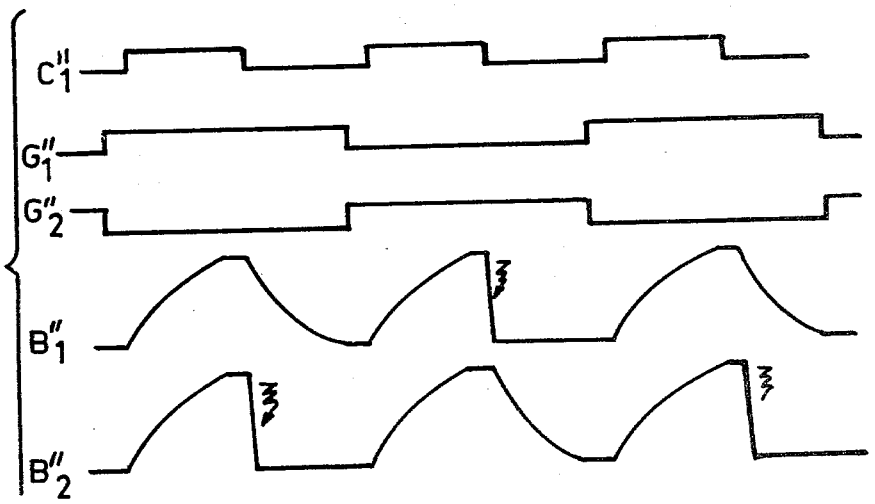
FIG. 7 represents the signals at various points of the circuit of FIG. 6.

FIG. 6 shows a further embodiment of the invention. In this device, the same elements will be found again as in the device of FIG. 1. The corresponding elements of the two Figures, have therefore been allotted the same reference numbers. The only difference existing between the circuit of FIG. 6 and that of FIG. 1 derives from the fact that the primary windings 7 and 8 are no longer arranged in series but are arranged in parallel with respect to each other; the thyristors 17 and 18 are still connected to shunt the terminals of primary windings 7 and 8, respectively, and their gates are controlled by complementary signals coming from amplifier 16. The signals applied to the two gates $G''_1$ and $G''_2$ of the two thyristors 17 and 18 respectively, have been represented on the second and third lines, respectively, of FIG. 7. The control signal obtaining at point $C''_1$ for the control of the contact breaker 9 has been represented on the first line of FIG. 7. The signals represented on the first three lines of FIG. 7 thus have exactly the same structure and the same relative disposition as those which are represented on the first three lines of FIG. 5.

When the signal at point $C''_1$ is at its high level, the contact breaker 9 is closed, and the two primary windings 7 and 8, arranged in parallel, will be energised simultaneously. During this energisation, the signal applied to one of the gates (for example at thyristor 17) is at its high level, whereas the other is at its low level (for example at thyristor 18). At the instant when the control signal of contact breaker 9 passes to its low level, the current circulating in winding 7 passes through the shunt thyristor 17 which is conductive and this current circulates in a closed circuit comprising primary winding 7 and shunt thyristor 17; this corresponds to a relatively slow discharge and does not cause any spark to appear on sparking plugs 12 and 13. On the other hand, because the other thyristor 18 is extinguished when contact breaker 9 opens, the current is suddenly interrupted in primary winding 8 and, by way of induction, a voltage surge is produced at the terminals of the primary winding 8 and consequently, a discharge on plugs 14 and 15. A diode 21 is interposed between each primary winding and the contact breaker 9, so that the voltage surge appearing at the terminals of one of the primary windings would not disturb the other.

Before the beginning of the following cycle, that is to say, before the following rising front of the control signal of the contact breaker 9 materialises, the signals to gates $G''_1$ and $G''_2$ are reversed.

When subsequently the primary windings 7 and 8 are re-energised, this energisation will be followed by a discharge in that coil which has not been subjected to rapid discharge in the preceding cycle. On the fourth and fifth lines of FIG. 7, there have been shown the current curves, with respect to time, at $B''_1$ and $B''_2$ of the circuit, that is to say, in the primary windings 7 and 8.

When the embodiments of FIGS. 1 and 6 are compared, it will be seen that the merit of the circuit of FIG. 1 derives from the fact that transistor 11 of the contact breaker circuit 9 takes a current i which produces the energisation of windings 7 and 8, whereas in the circuit of FIG. 6, the transistor 11 must take the current 2*i*. Thus in the first case, the contact breaker is clearly less costly. Nevertheless, the circuit of FIG. 1 has a disadvantage in relation to that of FIG. 6 in that the time of energisation of the two primary windings 7 and 8 is much longer than in the case of the circuit of FIG. 6, which is important when the engine is rotating at high speeds. This disadvantage of the circuit of FIG. 1 is nevertheless moderated by the fact that it is possible, when the motor is running at high speeds, to recover a part of the energy stored in the primary winding from the preceding energisation phase as has been previously indicated.

It shall be duly understood that the embodiments described above are in no way restrictive and may give rise to any desirable modifications without thereby departing from the scope of the invention as defined by the claims.

I claim:

1. A device for the distribution of high tension for the ignition of the sparking plugs of an internal combustion engine, this device comprising: a plurality of ignition coils each comprising a primary induction winding and a secondary induced winding; a set of sparking plugs; means connecting each sparking plug with at least one of the said ignition coil secondary windings, there being at least as many sparking plugs as there are ignition coils; a plurality of switch means such that there are as many said switch means as there are ignition coils; means connecting each said switch means to shunt a respective one of said primary windings; means operating said switch means successively in the course of time, and in timed relation with the rotation of the engine; a single contact breaker means connected in series with all said primary windings, and means connecting said switch means and said contact breaker means for ensuring that at the instant when the contact breaker means opens, at least one of said switch means is open.

2. A device according to claim 1 wherein said connecting means are effective to ensure that at the instant when said contact breaker means opens, a single one of said switch means is open and all the other said switch means are closed.

3. A device according to any one of claims 1 and 2, wherein the primary windings of said ignition coils are arranged in parallel.

4. A device according to any one of claims 1 and 2, wherein said switch means are thyristors.

5. A device according to claim 4, wherein said primary windings are connected in series and the thyristor shunting each ignition coil primary winding is arranged so that when the contact breaker is open and the thyristor is triggered the thyristor passes current only in the reverse direction to that which would correspond to current circulation in a closed circuit including that thyristor and the primary winding shunted thereby.

6. A device according to claim 5, wherein each said thyristor has a cathode, anode, and gate, and a triggering circuit; and including (a) a diode connected between the cathode of each thyristor to the gate thereof, said diode being polarised to pass current in the direction from said cathode to said gate, and (b) another diode connected to said gate and polarised to block the voltage of the gate in order to protect said triggering circuit of the said gate.

7. A device according to claim 4, wherein said primary windings are connected in parallel and including diode means connected between, on the one hand, each primary winding and shunting thyristor and, on the other hand, said single contact breaker means, said diode means being polarised to pass current in a direction from said primary winding towards said contact breaker means.

8. A device according to any one of claims 1 and 2, wherein there are four said sparking plugs and two said ignition coils, two of said sparking plugs being connected to the secondary winding of one of the ignition coils, and the other two of said sparking plugs being connected to the secondary winding of the other of said ignition coils, and the two sparking plugs connected to the same ignition coil secondary winding are in a pair of cylinders timed such that one cylinder of the said pair is on the exhaust stroke while the other is on the power stroke.

9. A device for the distribution of high tension for the ignition of the sparking plugs of an internal combustion engine, this device comprising: a plurality of ignition coils each comprising a primary induction winding and a secondary induced winding; a set of sparking plugs; means connecting each sparking plug with at least one of the said ignition coil secondary windings, there being at least as many sparking plugs as there are ignition coils; a plurality of switch means such that there are as many said switch means as there are ignition coils; means connecting each said switch means to shunt a respective one of said primary windings; means operating said switch means successively in the course of time, and in timed relation with the rotation of the engine; a single contact breaker means connected in series with all said primary windings, and wherein the primary windings of the said ignition coils are arranged in series.

10. A device for the distribution of high tension for the ignition of the sparking plugs of an internal combustion engine, this device comprising: a plurality of ignition coils each comprising a primary induction winding and a secondary induced winding; a set of sparking plugs; means connecting each sparking plug with at least one of the said ignition coil secondary windings, there being at least as many sparking plugs as there are ignition coils; a plurality of switch means such that there are as many said switch means as there are ignition coils; means connecting each said switch means to shunt a respective one of said primary windings; means operating said switch means successively in the course of time, and in timed relation with the rotation of the engine; a single contact breaker means connected in series with all said primary windings, wherein said switch means are thyristors, and wherein said primary windings are connected in series and the thyristor shunting each ignition coil primary winding is arranged such that, when it is triggered and when the contact breaker is open, said thyristor passes current in the direction corresponding to a current circulation in a closed circuit comprising that thyristor and the said primary winding shunted thereby.

11. A device for distribution of high tension for the ignition of the sparking plugs of an internal combustion engine, this device comprising: a plurality of ignition coils each comprising a primary induction winding and a secondary induced winding; a set of sparking plugs; means connecting each sparking plug with at least one of the said ignition coil secondary windings, there being at least as many sparking plugs as there are ignition coils; a plurality of switch means such that there are as many said switch means as there are ignition coils; means connecting each said switch means to shunt a respective one of said primary windings; means operating said switch means successively in the course of time, and in timed relation with the rotation of the engine; a single contact breaker means connected in series with all said primary windings, and wherein said contact breaker means comprises a power transistor.

12. A device according to claim 11, including a sensor for emitting signals and which includes a movable element driven to rotate at a speed proportional to the speed of rotation of the engine and including means applying directly or indirectly to the base of said power transistor the signals emitted by said sensor.

13. A device according to claim 12, and including connected between said sensor and the contact breaker means, means effective to determine the instant of closing of said contact breaker means so as to obtain a constant energisation level for ignition.

14. A device for the distribution of high tension for the ignition of the sparking plugs of an internal combustion engine, this device comprising: a plurality of ignition coils each comprising a primary induction winding and a secondary induced winding; a set of sparking plugs; means connecting each sparking plug with at least one of the said ignition coil secondary windings, there being at least as many sparking plugs as there are ignition coils; a plurality of switch means such that there are as many said switch means as there are ignition coils; means connecting each said switch means to shunt a respective one of said primary windings; means operating said switch means successively in the course of time, and in timed relation with the rotation of the engine; a single contact breaker means connected in series with all said primary windings, and wherein said contact breaker means comprise the combination of two transistors in a "Darlington pair" arrangement.

15. Device according to claim 14 wherein said switch means are thyristors each having a gate, an anode, and a cathode, and including first sensor means controlling the gates of the thyristors, and second sensor means for controlling the contact breaker means.

16. A device according to claim 15, wherein the two sensor means each have a movable element and including a common shaft connected to drive both said movable elements.

17. A device according to claim 16, wherein said common shaft is a distributor drive shaft of an engine to which the device is connected.

18. A device according to claim 16, wherein there are four said sparking plugs, and two said ignition coils, two of said sparking plugs being connected to the secondary winding of one of the ignition coils, and the other two of said sparking plugs being connected to the secondary winding of the other of said ignition coils, and the two sparking plugs connected to the same ignition coil secondary winding are in a pair of cylinders timed such that one cylinder of said pair is on the exhaust stroke while the other is on the power stroke, and including means responsive to said second sensor means for applying a square wave signal to the contact breaker means for controlling the contact breaker means, and means responsive to said first sensor means for applying to the gates of the two thyristors square wave signals which are complementary to each other and whose changes in level are effected just before one of the two changes in level of a square wave signal which controls the contact breaker means.

* * * * *